US006223955B1

(12) United States Patent
Till

(10) Patent No.: US 6,223,955 B1
(45) Date of Patent: May 1, 2001

(54) TAPPING HEAD FOR TAPPING A LIQUID PRESSURIZED WITH GAS FOR EXAMPLE BEER

(75) Inventor: Rudolf Till, Däniken (CH)

(73) Assignee: Hygienic Design Engineering AG, Däniken (CH)

( * ) Notice: Subject to any disclaimer, the term of this patent is extended or adjusted under 35 U.S.C. 154(b) by 0 days.

(21) Appl. No.: 09/388,877

(22) Filed: Sep. 2, 1999

(30) Foreign Application Priority Data

Sep. 14, 1998 (DE) ..... 198 41 954

(51) Int. Cl.[7] ..... B65D 83/00; B65D 83/06; B65D 88/54; B67D 1/08

(52) U.S. Cl. ..... 222/400.7; 222/318; 222/148

(58) Field of Search ..... 222/400.7, 148, 222/318, 424

(56) References Cited

U.S. PATENT DOCUMENTS

| | | | | |
|---|---|---|---|---|
| 3,734,352 | * | 5/1973 | Dooley | 222/250 |
| 4,212,414 | * | 7/1980 | Beyens | 222/148 |
| 4,228,927 | | 10/1980 | Beyens et al. | 222/148 |
| 5,343,907 | * | 9/1994 | Wagner | 141/89 |
| 5,535,923 | | 7/1996 | Fujioka | 222/148 |

FOREIGN PATENT DOCUMENTS

| | | |
|---|---|---|
| 28 31 463 | 2/1979 | (DE) . |
| 91 09 177.2 | 12/1991 | (DE) . |
| 34 38 415 | 5/1994 | (DE) . |
| 0 759 409 | 8/1996 | (EP) . |
| 2 659 074 | 2/1991 | (FR) . |

* cited by examiner

*Primary Examiner*—David A. Scherbel
*Assistant Examiner*—Davis Hwu
(74) *Attorney, Agent, or Firm*—Collard & Roe, P.C.

(57) ABSTRACT

The invention relates to a tapping head with a cylinder cavity in which a plunger is arranged. The plunger is capable of moving up and down and is biased or loadable by a coil spring. The tapping head consists of a barrel connection housing connected with the cylinder cavity of the tapping head housing, a rising tube extending through the housing and the plunger and forming a channel for the beverage. The tapping head also has a slidingly arranged, sleeve-like tappet connected to the plunger and a connection for cleaning liquid. The connection for the cleaning liquid feeds into the tapping head housing in an annular gap between the rising tube and a tube surrounding the rising tube, and is connected there with the rising tube (rinsing position) or sealed by a seal (tapping position) depending on the position of the tappet. A transversely extending gas line is arranged in the plunger. In the lower tapping position of the plunger, the gas line connects via a feed line an annular gap extending around the surrounding tube and reaches into the barrel. A vacuum valve arranged in the housing has an inlet side connected to the cylinder cavity via a high-pressure line. The feed of water, gas and beverage takes place via one single system hose having conduits incorporated therein, and the hose is connectable to a system connection located on a side surface of the tapping head housing.

5 Claims, 5 Drawing Sheets

TAPPING HEAD FOR TAPPING A LIQUID PRESSURIZED WITH GAS FOR EXAMPLE BEER

BACKGROUND OF THE INVENTION

1. Field of the Invention

The present invention relates to a tapping head for tapping a liquid pressurized with gas, for example beer.

2. The Prior Art

A tapping head described in EP-A 0 759 409 substantially consists of a rising tube arranged in a cylinder having a connection for pressurized gas; a housing connected with the cylinder; a $CO_2$ feed line for the beverage arranged on the housing, and a plunger for feeding and discharging pressurized gas movably arranged in the interior of the housing. The plunger in this known tapping head is loaded by a coil spring and is connected with a sleeve-like tappet slidingly arranged between the housing and the rising tube, which has a conical sealing surface and boreholes located on its underside. A water connection line feeds into the tappet which, in the tapping position, connects an annular gap with the beverage feed line, and with a water feed line in the rinsing position.

The present invention is based on the problem of substantially improving the known tapping head in view of simplification of the system and operating safety of the tapping head.

SUMMARY OF THE INVENTION

The present invention proposes to solve this problem by providing a tapping head comprising:

(a) a tapping head housing having a side surface;

(b) a cylinder cavity formed in the tapping head housing;

(c) a plunger movably arranged in the cavity and biased by a coil spring, the plunger being movable up and down and having a lower tapping position;

(d) a barrel connection housing connected to the tapping head housing;

(e) a rising tube extending through the tapping head housing and the plunger, the tube forming a channel for a beverage;

(f) a surrounding tube surrounding the rising tube and separated therefrom by a first annular gap;

(g) a connection for cleaning liquid feeding into the first annular gap between the rising tube and the surrounding tube;

(h) a tappet slidingly arranged on the surrounding tube and connected to the plunger, said tappet having a rinsing position in which the cleaning liquid is connected to the rising tube and a tapping position in which the cleaning tube is sealed off;

(i) a feed line having a pressure controller arranged in the housing, the controller having an inlet side connected to the cylinder cavity via a first pressure line;

(j) a transversely extending gas line arranged in the plunger, the gas line, in the lower tapping position, connecting a second annular gap extending around the surrounding tube and communicatively connected to a beverage barrel via the feed line;

(k) a system connection on the side surface of the tapping head housing; and (l) one single system hose having a plurality of conduits via which the feed of water, gas and beverage takes place, the hose being connectable to the system connection.

This tapping head offers a number of important advantages over the known tapping head. First, the water connection for the cleaning water is not movable, which is advantageous because movements of the water connection may cause injury to the person operating the tapping head. Furthermore, the connection of the gas feed in the interior of the plunger and the introduction of a pressure reducer in the tapping head improve the conditions with respect to the feed or adjustment of the reduced pressurized gas of the beverage. Finally, additional advantages ensue from the special design of the introduction of a system feed hose containing all lines, as well as from the use of the pressure employed for actuating the cylinder to adjust, with the help of the pressure reducer, the pressure of the beverage.

BRIEF DESCRIPTION OF THE DRAWINGS

The tapping head as defined by the invention and its mode of operation are explained in greater detail in the following with the help of preferred exemplified embodiments and the drawings, in which.

Figure 1:
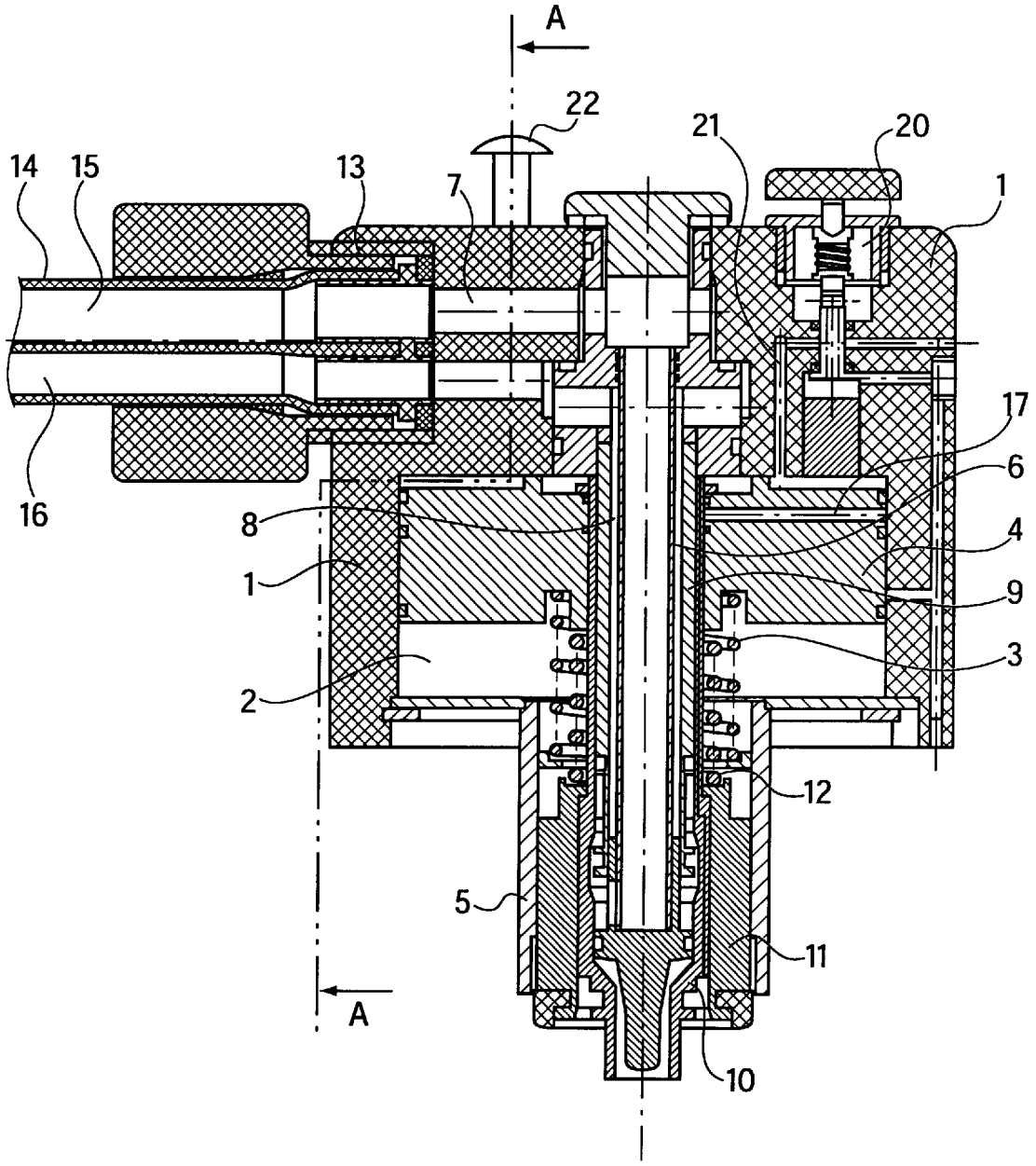
FIG. 1 is a basic cross section through the tapping head as defined by the invention, showing the device in the down position, i.e. in the rinsing position.

Tappet 10 is surrounded by a barrel connection housing 11, which is retracted in the down position according to FIG. 1. The return spring 12 for barrel connection housing 11 is stretched, i.e. pulled apart in the down position, i.e. when plunger 4 is in its top position. Coil spring 3 is in its expanded position as well.

Figure 2:
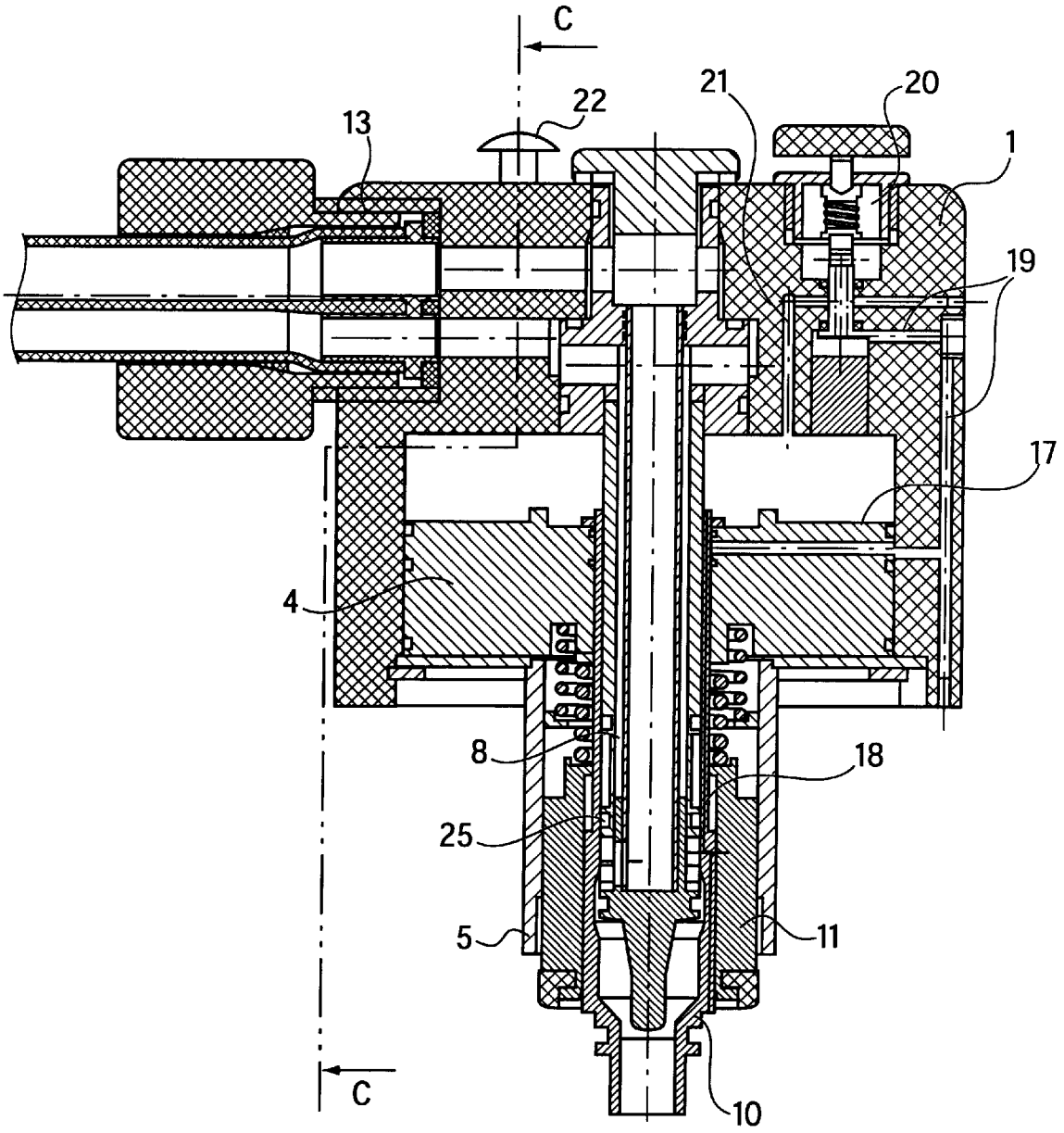
FIG. 2 shows the same cross section of the tapping head with the device in the up position, i.e. in the tapping position.

On the top side, tapping head housing 1 has a side connection 13, into which a system hose 14 can be plugged. System hose 14 has a plurality of lines for the gas, the beverage and the cleaning water. The lines are located in the form of through-extending cylindrical cavities provided in the solid material of the hose. FIGS. 1 and 2 show the feed line 15 for the beverage and the feed line 16 for the cleaning water, with feed line 16 leading into the annular gap formed between tube 9 and rising tube 6.

Furthermore, provision is made in plunger 4 for a transversely extending gas line 17, which is closed in the position shown in FIG. 1, and, in the position shown in FIG. 2, connects via a feed line 19 another annular gap 18 which is communicatively connected with the interior of the barrel. Annular gap 18 is equipped with a pressure reducer, for example vacuum valve 20. Pressure reducer 20 is connected via another line 21 with the upper part of the cylinder cavity 2, into which the normal gas pressure for actuating the plunger is admitted.

Figure 3:
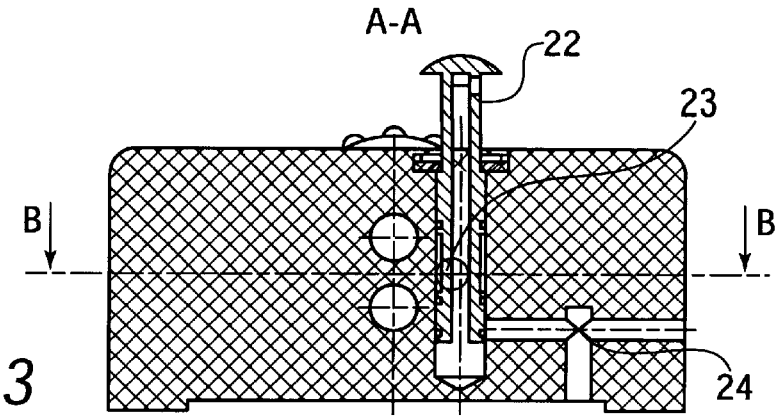
FIG. 3 is a section along line A—A in FIG. 1.
Figure 5:
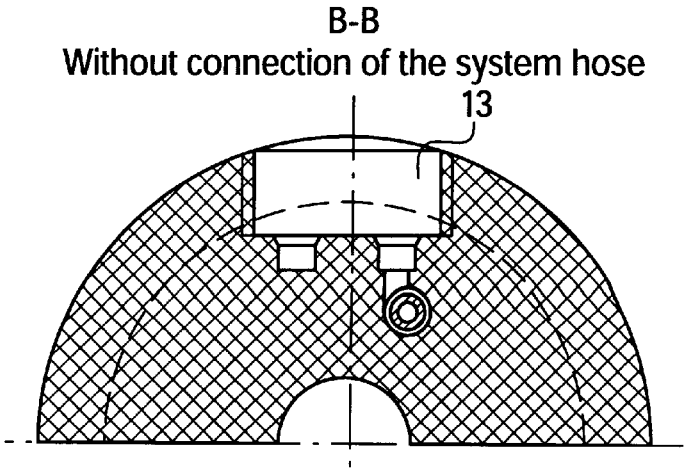
FIG. 5 is a section according to line B—B in FIG. 3.

As particularly shown in FIGS. 3 and 5, tapping head housing 1 is provided with switch 22, which is capable of opening and closing gas line 23, and a venting borehole 24. The connection 13 for the system hose shown in FIGS. 1 and 2 is shown in FIG. 5.

The function of the tapping head as defined by the invention is described as follows:

When gas pressure is admitted into cylinder cavity 2 via switch 22, plunger 4—which is connected with tappet 10—moves from guide 5 and barrel connection housing 11 and opens the beverage container. At the same time, barrel connection housing 11 is pressed against the barrel fitting via return spring 12, so that the gas flowing into the barrel via conveying gas channel 14 of plunger 4 and the borehole or annular gap 18 cannot escape to the outside and not get into the beverage line. Furthermore, cleaning channel 8 is closed by the displacement of tappet 10, as shown at 25 in FIG. 2. The tapping head is now located in the up position (FIG. 2). In this position, beverage flows via the beverage channel of rising tube 6 into line 7 and into the system hose on connection 13 through line 15.

When switch 22 is set to the venting position and vents the cylinder cavity 2, plunger 4, which is connected with tappet 10, is reset by springs 3, 12. The beverage barrel is closed at the same time and via the channel of rising tube 6, the detergent admitted by way of line 16 can now flow to the tappet cock. Barrel connection housing 11, on a narrowing 26 leading to tappet 10, is retracted via a driving thickening 27 into the housing of the tapping head and retained in the device. The intermediate pressure controller 20 is supplied with gas from cylinder cavity 2 via first pressure line 21. Intermediate pressure controller 20 reduces the gas from the driving cylinder to the pressure required for conveying the gas, for example from 3 bar to 1.2 bar.

Figure 4:
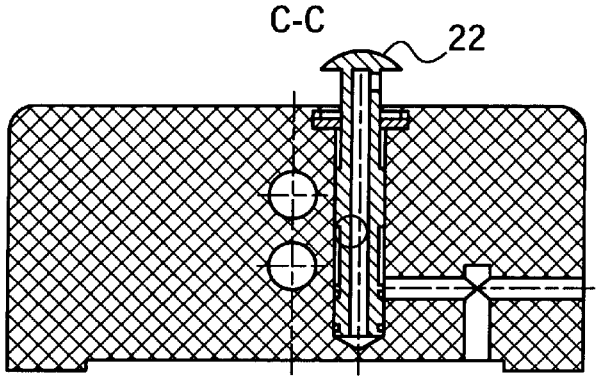
FIG. 4 is a section along line C—C in FIG. 2.

As shown in FIG. 4, switch 22 is in the lower end position. Gas line 23 is open, the actuating gas penetrates cylinder cavity 2 of the tapping head having via an annular gap through the ventilating and venting borehole 24, and the tapping head is fixed. System hose connection 13 is shown in the sectional representation of FIG. 5.

Figure 6:
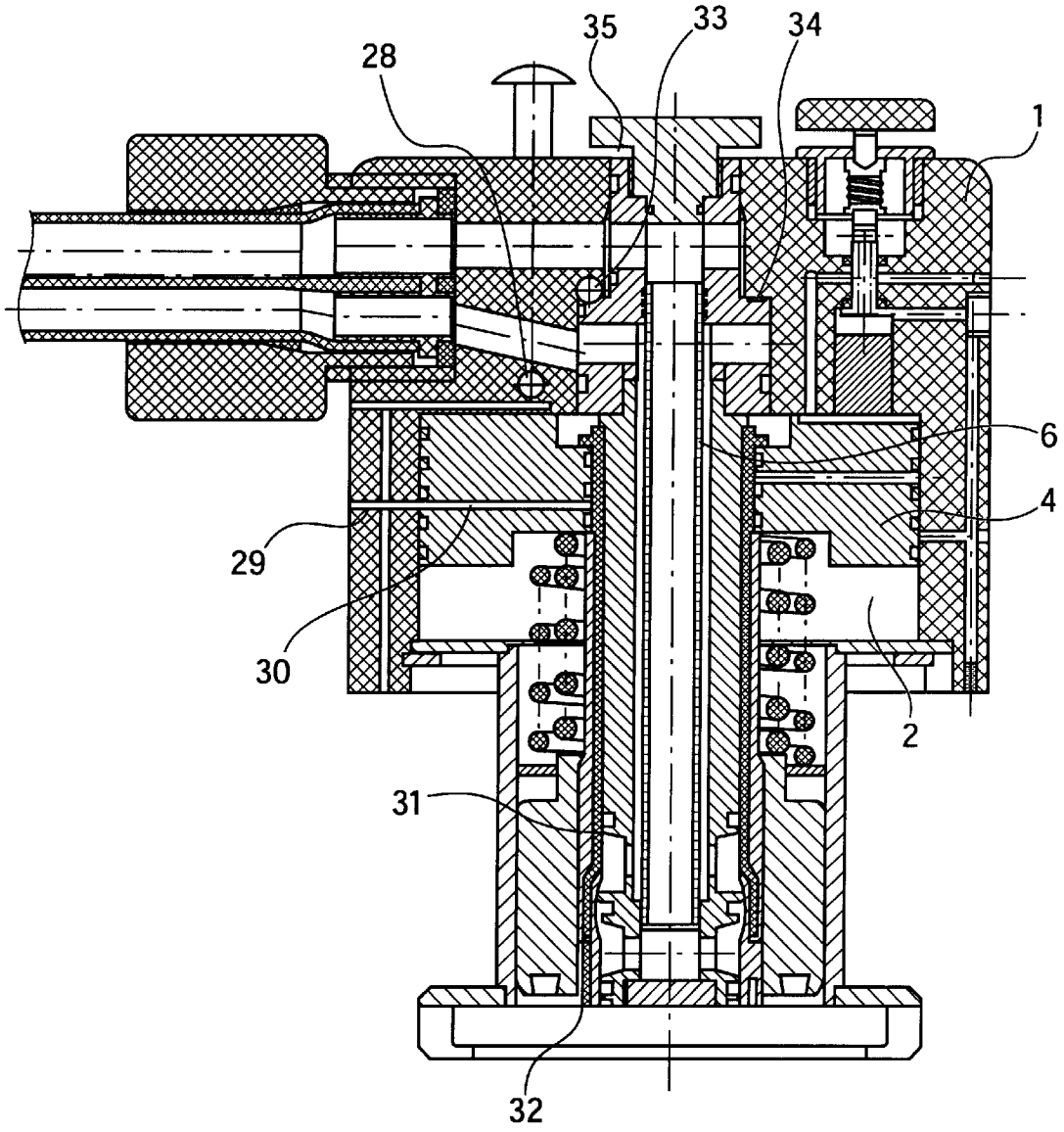
FIG. 6 is a section similar to the one in FIG. 1 of another embodiment showing a different design of the lower part of the rising tube.
Figure 7:
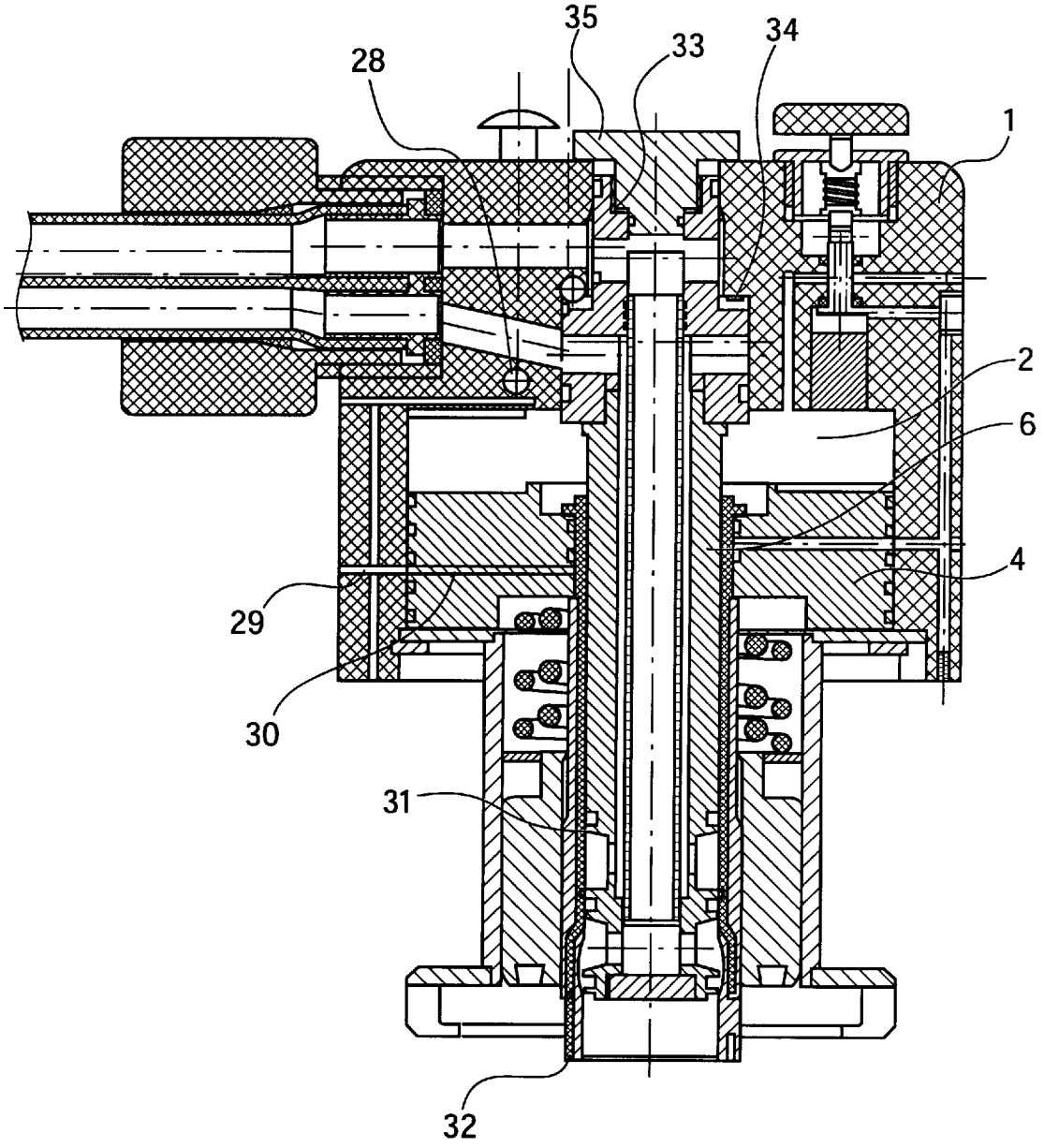
FIG. 7 shows a section similar to the one in FIG. 6, with the tapping head in the up position. DETAILED DESCRIPTION OF PREFERRED EMBODIMENTS As shown in the drawings, the tapping head as defined by the invention substantially consists of a tapping head housing 1 with a hollow cylinder chamber 2, in which a plunger 4 is arranged. The plunger is movable up and down by means of a coil spring 3 acting upon the plunger. A cylindrical guide 5 for a barrel connection housing is arranged on the underside of tapping head housing 1. A rising tube 6 for the beverage to be conveyed extends through the guide 5 and plunger 4 and, on the top side, feeds into a beverage line 7 extending transversely to the rising tube. Rising tube 6 is surrounded by another tube 9 with formation of an annular gap 8, and a sleeve-like tappet 10 protruding from the underside of guide 5 is slidingly arranged on tube 9.

FIGS. 6 and 7 show the same arrangement of the tapping head as defined by the invention for another design of the barrel connection.

In the down position of the tapping head shown in FIG. 6, housing 1 is provided with another line 28 for a disinfectant. Line 28 is connected to disinfection channel 29 and to feed line 30 via disinfection channel 31. From disinfection gap 32, the disinfectant can reach and wet the underside of the tapping head and the barrel fitting, so that both parts can be disinfected in the down position of the tapping head.

In the down position (FIG. 7), the activating pressure of cylinder cavity 35 is applied to a second pressure line 33 in the additional cylinder cavity 34 and presses rising tube 6 downwardly to such an extent that no hollow space is present between the fitting of the barrel and the rising tube. In this way, no leakage results when the tapping head or the barrel is released. In the released position, the pressure in cylinder cavity 34 is relieved and rising tube 6 is pushed again into its starting position by plunger 4.

Of course, the embodiment of the tapping head according to FIGS. 1 and 2 can be additionally provided with a disinfection line and a disinfection channel as well. Finally, disinfection line 28 and disinfection channel 31 also can serve at the same time as a $CO_2$-channel for feeding the gas.

It should be mentioned also that the tapping head can be used in many variations, e.g. in the form of a Guinness tapping head, a Konig tapping head, a flat tapping head, a basket tapping head, as a combined tapping head and as an "AfG" tapping head.

While several embodiments of the present invention have been shown and described, it is to be understood that many changes and modifications may be made thereunto without departing from the spirit and scope of the invention as defined in the appended claims.

What is claimed is:

1. A tapping head comprising:

(a) a tapping head housing having a side surface;

(b) a cylinder cavity formed in the tapping head housing;

(c) a plunger movably arranged in the cavity and biased by a coil spring, said plunger being movable up and down and having a lower tapping position;

(d) a barrel connection housing connected to the tapping head housing;

(e) a rising tube extending through the tapping head housing and the plunger, said tube forming a channel for a beverage;

(f) a surrounding tube surrounding the rising tube and separated therefrom by a first annular gap;

(g) a connection for cleaning liquid feeding into the first annular gap between the rising tube and the surrounding tube;

(h) a tappet slidingly-arranged on the surrounding tube and connected to the plunger, said tappet having a rinsing position in which the cleaning liquid is connected to the rising tube and a tapping position in which the cleaning liquid is sealed off;

(i) a feed line having a pressure controller arranged in the housing, the controller having an inlet side connected to the cylinder cavity via a first pressure line;

(j) a transversely extending gas line arranged in the plunger, said gas line, in the lower tapping position, connecting a second annular gap extending around the surrounding tube and communicatively connected to a beverage barrel via the feed line;

(k) a system connection on the side surface of the tapping head housing; and (l) one single system hose having a plurality of conduits via which the feed of water, gas and beverage takes place, said hose being connectable to the system connection.

2. The tapping head according to claim 1, wherein the system hose connected to the system connection consists of a hose made of solid material provided with through-extending cylindrical cavities serving as lines.

3. The tapping head according to claim 1, further comprising a second feed line having a disinfection channel and a disinfection gap, wherein the housing is provided with an additional line for a disinfectant, said additional line being connected to the disinfection channel of the feed line via the disinfection gap in a way such that from the disinfection gap, the disinfectant can wet the underside of the tapping head and the barrel fitting.

4. The tapping head according to claim 3, wherein an actuating pressure is applied in the cylinder cavity to a second pressure line and wherein the tapping head has an up position wherein the actuating pressure applied to a further cylinder cavity for pressing the rising tube downwardly into a fitting for the rising tube on the beverage barrel to such an extent that no hollow space is present between the barrel fitting and the rising tube.

5. The tapping head according to claim 3 wherein the disinfection line and the disinfection channel at the same time serve as a $CO_2$-channel for feeding the gas.

* * * * *